US006907922B2

(12) United States Patent
Katoh et al.

(10) Patent No.: US 6,907,922 B2
(45) Date of Patent: Jun. 21, 2005

(54) HEAT EXCHANGER

(75) Inventors: Yoshiki Katoh, Chita-gun (JP); Masaaki Kawakubo, Obu (JP); Ken Muto, Toyota (JP); Etsuo Hasegawa, Nagoya (JP)

(73) Assignee: DENSO Corporation, Kariya (JP)

( * ) Notice: Subject to any disclaimer, the term of this patent is extended or adjusted under 35 U.S.C. 154(b) by 102 days.

(21) Appl. No.: 10/874,112

(22) Filed: Jun. 22, 2004

(65) Prior Publication Data

US 2004/0256090 A1 Dec. 23, 2004

(30) Foreign Application Priority Data

Jun. 23, 2003 (JP) ..... 2003-178127
Mar. 4, 2004 (JP) ..... 2004-060731

(51) Int. Cl.[7] ..... F28F 1/00
(52) U.S. Cl. ..... 165/177; 165/178; 165/172; 138/38
(58) Field of Search ..... 165/172–173, 165/174–179, 181, 183, 140, 148, 168, 110; 138/38; 29/890.053

(56) References Cited

U.S. PATENT DOCUMENTS 5,476,141 A * 12/1995 Tanaka ..... 165/183
6,216,776 B1 * 4/2001 Kobayashi et al. ..... 165/173
6,289,981 B1 * 9/2001 Tokizaki et al. ..... 165/177
6,340,055 B1 * 1/2002 Yamauchi et al. ..... 165/174
6,357,522 B2 3/2002 Dienhart et al.
2002/0050337 A1 * 5/2002 Kaspar et al. ..... 165/41
2003/0209344 A1 * 11/2003 Fang et al. ..... 165/140
2004/0069477 A1 * 4/2004 Nishikawa et al. ..... 165/175

FOREIGN PATENT DOCUMENTS

JP 2000018867 A * 1/2000 ..... F28F 1/02
JP 2000-356488 12/2000

* cited by examiner

*Primary Examiner*—Tho v Duong
(74) *Attorney, Agent, or Firm*—Harness, Dickey & Pierce, PLC

(57) ABSTRACT

A heat exchanger is used in a vapor-compression type refrigerator where a pressure of a refrigerant at a high-pressure portion reaches and exceeds a critical pressure. A low-pressure refrigerant flows through the heat exchanger. The heat exchanger comprises a flat tube; refrigerant channels included in the tube; and inner pillars disposed between the refrigerant channels. A tensile strength of material of the tube is defined as S [N/mm$^2$]; of one of the refrigerant channels, a dimension approximately parallel with a major-axis direction of the tube, as Wp [mm]; and, of one of the pillars, a thickness approximately parallel with the major-axis direction of the tube, as Ti [mm]. Here, $[447\times Wp/\{10\hat{}(1.54\times\log_{10}S)\}-533/\{10\hat{}(1.98\times\log_{10}S)\}]\leqq Ti\leqq[447\times Wp/\{10\hat{}(1.54\times\log_{10}S)\}-533/\{10\hat{}(1.98\times\log_{10}S)\}]\times 2.3$.

11 Claims, 7 Drawing Sheets

HEAT EXCHANGER

CROSS REFERENCE TO RELATED APPLICATIONS

This application is based on and incorporates herein by reference Japanese Patent Applications No. 2003-178127 filed on Jun. 23, 2003, and No. 2004-60731 filed on Mar. 4, 2004.

FIELD OF THE INVENTION

The present invention relates to a heat exchanger disposed at a low-pressure portion of a vapor-compression type refrigerator where a pressure of a refrigerant reaches and exceeds a critical pressure of the refrigerant; it is effectively applicable to an evaporator of the vapor-compression type refrigerator using a refrigerant of carbon dioxide.

BACKGROUND OF THE INVENTION

In a vapor-compression type refrigerator using a refrigerant of carbon dioxide ($CO_2$), a refrigerant pressure is needed to reach and exceed a critical pressure of the refrigerant in a high-pressure portion when an ambient temperature is high (more than 30 degrees Celsius [° C.]). The pressure at the high-pressure portion is thereby approximately ten times as high as that of a vapor-compression type refrigerator using a refrigerant of chlorofluorocarbon (CFC); accordingly, the pressure at the low-pressure portion is also approximately ten times as high as that of the vapor-compression type refrigerator using the refrigerant of chlorofluorocarbon.

Cross-sectional areas of refrigerant channels are therefore circular or elliptic so that withstanding pressure can be increased (refer to JP-A-2000-111290 [U.S. Pat. No. 6,357,522 B2]). However, in a viewpoint of heat conductivity, an angled cross-sectional area (e.g., rectangular) is preferable. This angled cross-sectional area is described in JP-A-2000-356488 (JP3313086 B2), which provides an optimum example of a heat exchanger at a supercritical pressure. However, since its usage pressure falls within a high-pressure region (about 10 MPa) of a $CO_2$ cycle, it does not provide an optimum example as an evaporator. Further, it provides; without specification of used material, no optimum pressure-withstanding design for a $CO_2$ cycle that is operated especially at high pressures. Further, a refrigerant state is different between an evaporator and heat exchanger, so that contribution of a shape should be considered with respect to a refrigerant-side performance.

Further, rectangular cross-sectional areas of refrigerant channels having arcuate corners in JP-A-2000-356488, are inferior in heat conductivity to those having angled (not-arcuate) corners. In comparison with the arcuate corners (e.g., circular corners) having equivalent cross-sectional areas, the angled corners secure broader conductive areas in the refrigerant side, and thicker annular liquid films, further enabling uneven distribution of the liquid. It is assumed that the foregoing phenomena remarkably contribute to nucleate boiling.

Thus, the heat exchangers described in JP-A-2000-356488 is suitable as a radiator at a high-pressure portion, not being directly applicable to heat an exchanger at a low-pressure portion such as an evaporator. Moreover, refrigerant channels having angled cross-sectional areas are potentially involved in tube damage owing to stress concentration. In particular, attention must be paid to the channels having corners of nearly right angles.

SUMMARY OF THE INVENTION

It is an object of the present invention to provide a heat exchanger suitable for being disposed at a low-pressure portion of a vapor-compression type refrigerator using a refrigerant of carbon dioxide.

To achieve the above object, a heat exchanger used in a vapor-compression type refrigerator where a pressure of a refrigerant at a high-pressure portion reaches and exceeds a critical pressure, is provided with the following. A low-pressure refrigerant flows through the heat exchanger. The heat exchanger comprises a flat tube; refrigerant channels that are included in the tube; and inner pillars that are disposed between the refrigerant channels. A tensile strength of material of the tube is defined as S [$N/mm^2$]; of one of the refrigerant channels, a dimension approximately parallel with a major-axis direction of the tube is defined as Wp [mm]; and, of one of the pillars, a thickness approximately parallel with the major-axis direction of the tube is defined as Ti [mm]. Here, $[447\times Wp/\{10\hat{}(1.54\times\log_{10}S)\}-533/\{10\hat{}(1.98\times\log_{10}S)\}]\leqq Ti\leqq[447\times Wp/\{10\hat{}(1.54\times\log_{10}S)\}-533/\{10\hat{}(1.98\times\log_{10}S)\}]\times 2.3$.

BRIEF DESCRIPTION OF THE DRAWINGS

The above and other objects, features, and advantages of the present invention will become more apparent from the following detailed description made with reference to the accompanying drawings. In the drawings:

FIG. 3 is a graph showing pressure-withstanding lines with respect to a relation between Ti and To;

DETAILED DESCRIPTION OF THE PREFERRED EMBODIMENTS (First embodiment)

A heater exchanger of the present invention is directed to, as a first embodiment, an evaporator of a vehicular air-conditioner using a vapor-compression type refrigerator whose refrigerant is carbon oxide ($CO_2$). In this vapor-compression type refrigerator, a low-pressure refrigerant is evaporated in a heat exchanger at a low-pressure portion (low-pressure-end heat exchanger, such as an evaporator) to absorb heat in a low-pressure portion; this evaporated gaseous refrigerant is compressed to increase its temperature; thereby, the absorbed heat is radiated at a high-pressure portion. The refrigerator generally includes a compressor, a radiator, a decompressor, and an evaporator.

Figure 1:
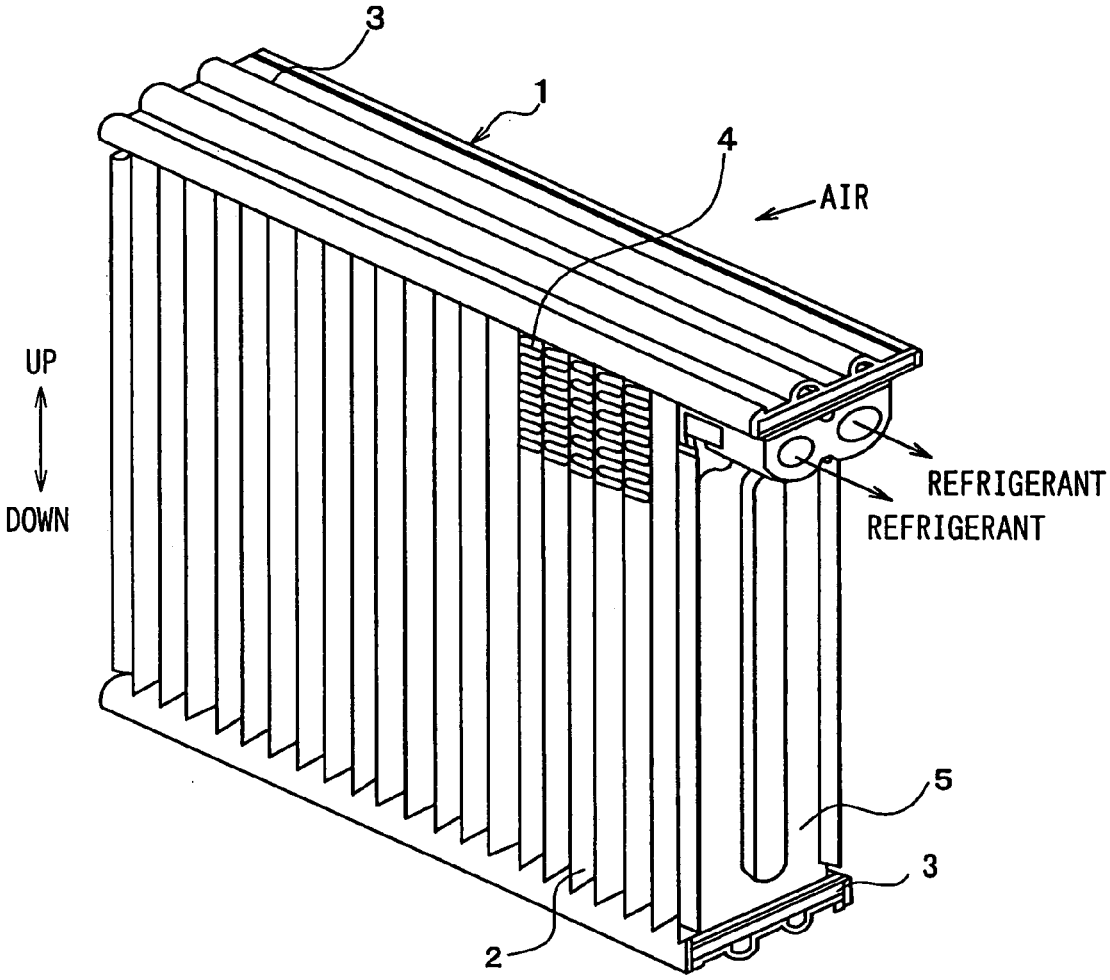
FIG. 1 is a perspective view of an evaporator according to a first embodiment of the present invention.

As shown in FIG. 1, an evaporator 1 includes multiple tubes 2 where a refrigerant passes; head tanks 3 disposed at both ends of the longitudinal direction (vertical direction in FIG. 1) of the tubes 2 to fluidly communicate with the tubes 2; wavelike fins 4 joined with the outer surfaces of the tubes 2 to increase areas radiating heat to air; a side plate 5 disposed at the end of a heat exchange core constituted by the fins 4 and tubes 2 to reinforce the heat exchange core, etc.

In this embodiment, these components of the tubes 2, the head tanks 3, and the like are formed of aluminum alloy and integrated using brazing or soldering. As described in a book of "Setsuzoku/Setshgou Gijyutsu (connection/joint technology)" published by Tokyo-denki-daigaku-syuppan-kyoku (Tokyo Denki University Press), the "brazing or soldering" is a technology enabling joint without main bodies being melted. For instance, "brazing" is a technology where joint is performed using filler metal ("brazing filler metal") having a melting point of not less than 450 degrees Celsius (° C.), while "soldering" is a technology where joint is performed using filler metal ("solder") having a melting point of not more than 450° C.

Figure 2A:
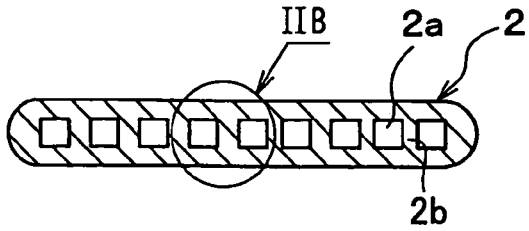
FIG. 2A is a cross-sectional view of a tube according to the first embodiment.

Further, as shown in FIG. 2A, a tube 2 is a flat tube and includes multiple refrigerant channels 2*a* having cross-sectional areas of angled holes (squares in this embodiment). The tube 2 and multiple refrigerant channels 2*a* are at a time formed by an extruding or drawing process. Here, a partition portion 2*b* between adjacent channels 2*a* is referred to as an inner pillar.

Next, of the evaporator 1, dimensions and the like of the tube 2 that are features of this embodiment will be explained below with reference to FIG. 2B.

Definitions and the like are as follows:

- To: thickness [mm] of tube 2, approximately parallel with minor axis (vertical direction in FIG. 2B) of tube 2, or plate thickness of periphery of tube 2;
- Ti: thickness [mm] of inner pillar 2*b*, approximately parallel with major axis (horizontal direction in FIG. 2B) of tube 2;
- Wp: dimension [mm] of refrigerant channel 2*a*, approximately parallel with major axis of tube 2, channel width;
- Hp: dimension [mm] of refrigerant channel 2*a*, approximately parallel with minor axis of tube 2, channel height; and
- S: tensile strength [N/mm$^2$] of material of tube 2.

Here, a tensile strength of the material of the tube 2 is a result of tensile test complying with JIS H 4100. In this embodiment, the material of the tube 2 is A1060-O, having a tensile strength of 70 N/mm$^2$.

In this specification, "approximately something" includes "accurately something" in addition to "approximately something." For instance, "approximately parallel" includes "accurately parallel" in addition to "approximately parallel."

Figure 3:
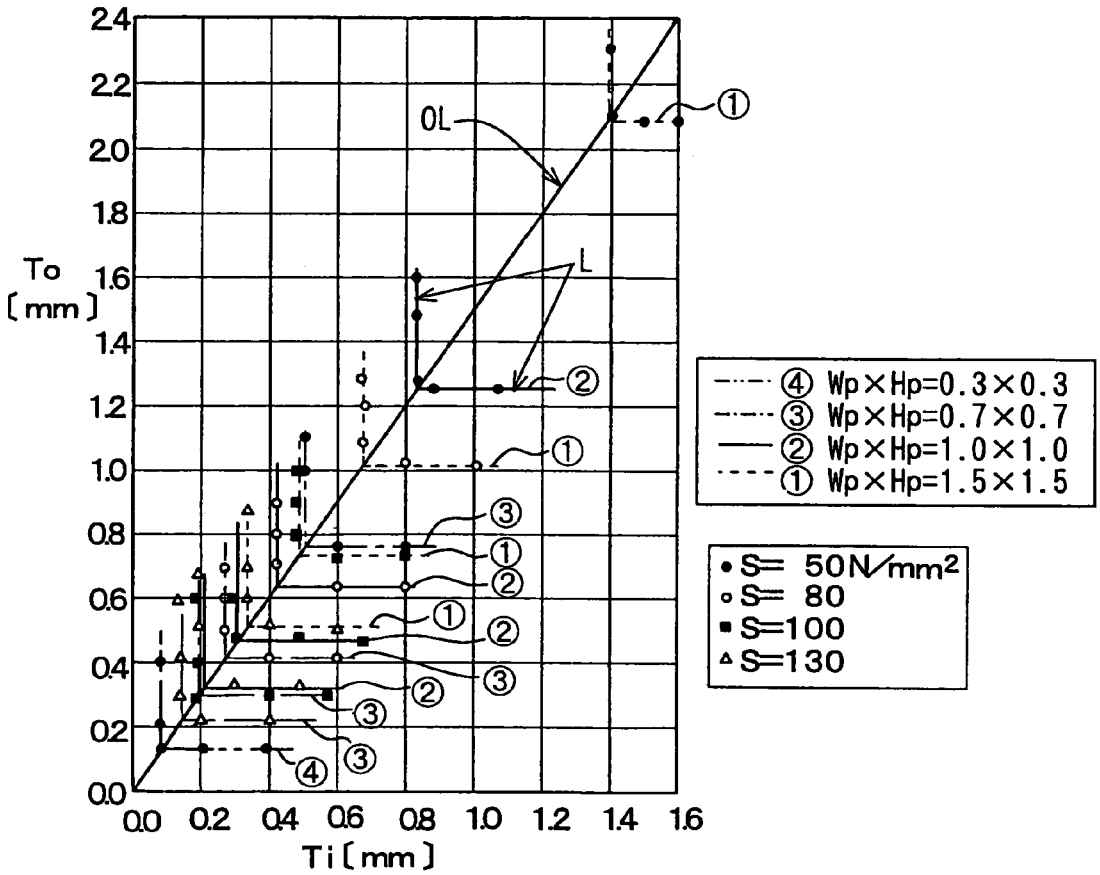

Referring to FIG. 3, a relationship between To and Ti enabling the maximum stress to be not more than an allowable stress will be explained. This results from an arithmetic simulation, where a pressure inside the tube 2 is maintained to be constant (approximately 30 MPa) while dimensions Wp, Hp of the refrigerant channel 2*b* are varied. The tube 2 is not broken, owing to an internal pressure, within a region that is upper and more rightward than an L-shaped line L in FIG. 3.

Accordingly, a line OL that is formed by connecting bending points of the L-shaped lines is an optimum ratio line between To and Ti, Ti being represented as follows:

$$Ti=447\times Wp/10^{A}-533/10^{B},$$

where A=(1.54×$\log_{10}$S), and B=(1.98×$\log_{10}$S).

Hereinafter, this formula is referred to as a basic formula. The basic formula is derived from the following method. A relationship between the inner pillar thickness Ti and channel major-axis dimension Wp is computed with respect to each tensile strength S by a least squares method (Ti=αWp+β). A relational formula of the proportionality constant a and constant α with respect to the tensile strength S is obtained (α=f(S), β=f(S)). These are more accurately approximated using logarithm approximation. The values of α, β that are represented by logarithm approximate expression are inserted to Ti (=αWp+β) that is obtained by the least squares method, so that the basic formula of Ti is computed.

Figure 4:
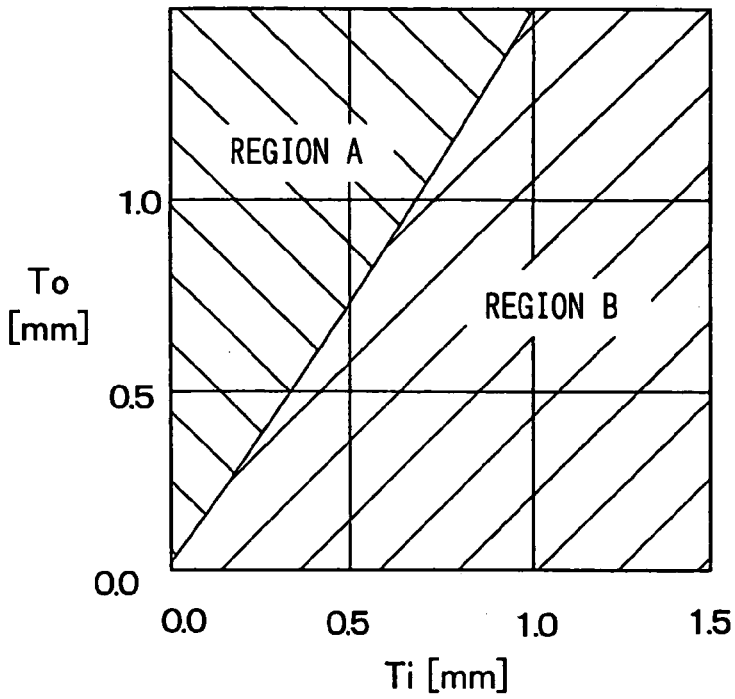
FIG. 4 is a graph showing regions where maximum stress is applied with respect to To and Ti.

Further, regions where the maximum stress is generated are shown in FIG. 4 based on the arithmetic simulation results shown in FIG. 3. The region A shows where the maximum stress occurs in the inner pillar 2*b* regardless of values of To and Ti, while the region B, in the portion approximately parallel with the minor axis (vertical direction in FIG. 2B) of the tube 2. Supposed that given Ti satisfies the above basic formula and is upon the boundary line between the regions A, B (given To corresponds to given T1 on the boundary). Here, the given To and given Ti are the minimum values among T0 and Ti, respectively, where no breakage of the tube 2 is possible.

Figure 5:
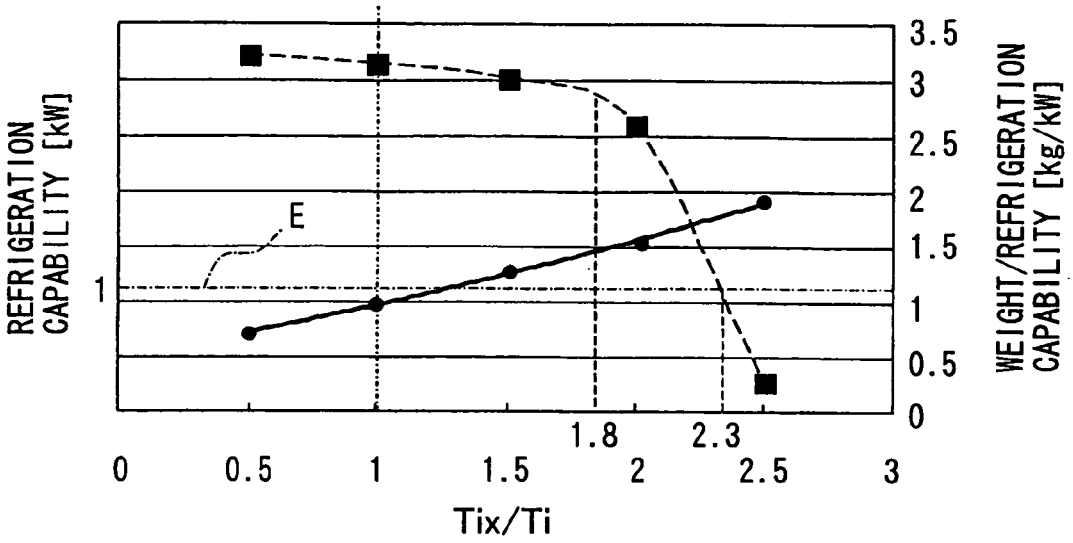
FIG. 5 is a graph showing, with respect to Tix/Ti, both refrigeration capability and a ratio of weight to refrigeration capability.

Next, the optimum region of Ti will be explained with reference to FIG. 5. The graph in FIG. 5 shows relationships between refrigeration capability and a Ti ratio (Tix/Ti) and between weight/refrigeration capability and the Ti ratio. Here, Ti is calculated from the basic formula, while Tix is varied from Ti. The dotted line is for the refrigeration capability, while solid, for weight/refrigeration. As explained above, Ti calculated from the basic formula is the minimum value under the condition where withstanding pressure is possible (i.e, no breakage of the tube 2 occurs), so that the tube 2 will be broken when the Ti ratio is less than one (Tix<Ti). Accordingly, the lower limit of Ti should be based on the basic formula. Next, the upper limit of Ti will be determined. As Ti ratio increases, a pressure loss of the refrigerant increases, decreasing the refrigeration capability. line. A line E of a conventional refrigeration capability using the applicants' refrigerant of R134a is shown as a target point in FIG. 5; the Ti ratio of 2.3 or less is thereby obtained to at least secure the conventional refrigeration capability. Namely, $$447\times Wp/10^{A}-533/10^{B}\leqq Ti\leqq 2.3\times(447\times Wp/10^{A}-533/10^{B}),$$

where A=(1.54×$\log_{10}$S), and B=(1.98×$\log_{10}$S).

Further, since the refrigeration capability remarkably decreases from approximately 1.8, preferable Ti region is additionally set as follows:

$$447\times Wp/10^{A}-533/10^{B}\leqq Ti\leqq 1.8\times(447\times Wp/10^{A}-533/10^{B}),$$

where A=(1.54×$\log_{10}$S), and B=(1.98×$\log_{10}$S).

Figure 6:
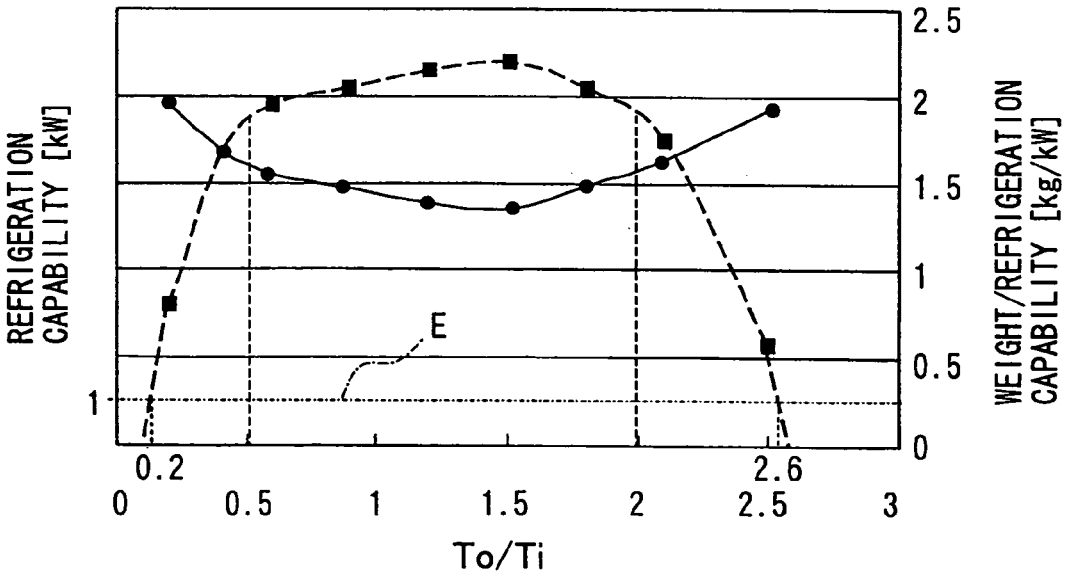
FIG. 6 is a graph showing, with respect to To/Ti, both refrigeration capability and a ratio of weight to refrigeration capability.

Next, the optimum region of a ratio of To and Ti will be explained with reference to FIG. 6. The dotted line is for the refrigeration capability, while solid, for weight/refrigeration. The refrigeration capability is shown as a curve upward protruding around the center with respect to To/Ti. In similarly with the case in FIG. 5, the region of To/Ti from 0.2 to 2.6 ($0.2 \leqq To/Ti \leqq 2.6$) is thereby obtained to at least secure the conventional refrigeration capability.

Further, since the refrigeration capability remarkably decreases at To/Ti of less than 0.5 and more than 2.0, a preferable To/Ti region is additionally set between 0.5 and 2.0, including 0.5 and 2.0 ($0.5 \leqq To/Ti \leqq 2.0$).

Further, when the tube is practically designed, an additional thickness is preferably required for a manufacturing tolerance in addition to the thickness withstanding pressure and a tolerance against corrosion while the usage. In particular, the evaporator undergoes repeated wet conditions, so that it is subject to the corrosion. The additional thickness as the tolerance for Ti is approximately 0.05 to 0.25 mm, while an additional thickness for To is approximately 0.05 to 0.40 mm. In consideration of the above, practical Ti' and To' are required to be set as follows:

$$Ti+0.05 \leqq Ti' \leqq Ti+0.25,$$

$$To+0.05 \leqq To' \leqq To+0.40.$$

Further the optimum To/Ti is 1.5; therefore, $$1.5\times(Ti-0.25)+0.05 \leqq To \leqq 1.5\times(Ti-0.05)+0.40$$

As a result, a preferable range of practical thickness ratio of To'/Ti' is set as follows:

$$1.5-0.325/Ti' \leqq To'/Ti' \leqq 1.5+0.325/Ti'.$$

For instance, when Ti' is equal to 1 mm, $1.175 \leqq To'/Ti' \leqq 1.825$.

Figure 7:
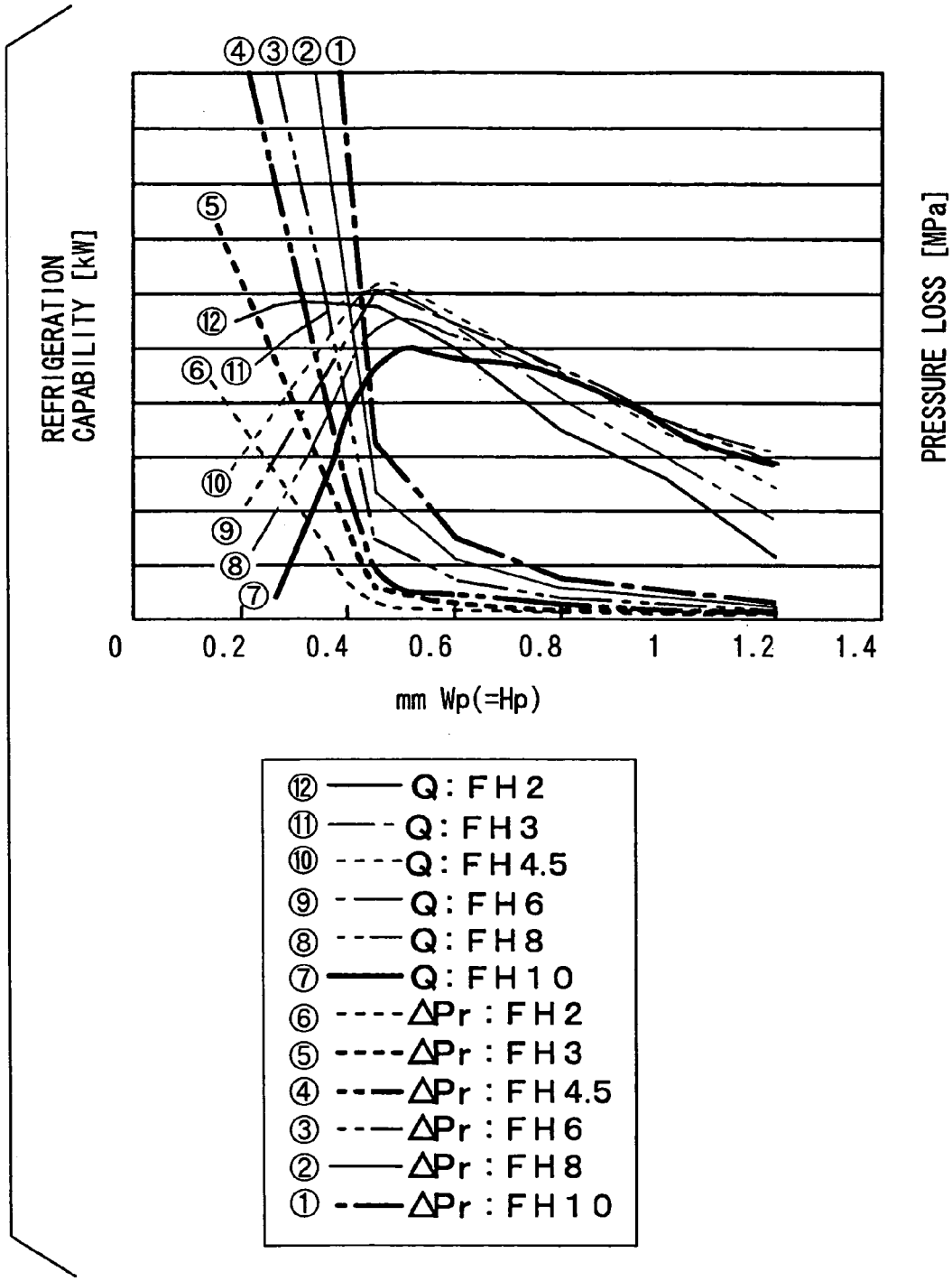
FIG. 7 is a graph showing, with respect to Wp, both refrigeration capability and pressure drop.

Further, as a cross-sectional area of the refrigerant channel 2*a* decreased, the flow velocity increases to thereby increase heat conductivity; as a cross-sectional area of the refrigerant channel 2*a* decreased, a pressure loss increases as shown in FIG. 7. This means that there is a cross-section area of the refrigerant channel 2*a* maximizing the refrigeration capability.

Here, in FIG. 7, "Q" means refrigeration capability; "ΔPr" means pressure loss; and "FH" means a height of fins 4, i.e. a difference between top and bottom of the fines 4, e.g., "FH2" means that the height of the fins 4 is 2 mm. Accordingly, "Q:FH2" means refrigeration capability at the fins of 2 mm high; "ΔPr:FH 2" means pressure loss at the fins of 2 mm high.

In this embodiment, in consideration of the result of the arithmetic simulation shown in FIG. 7, dimension Wp is set between 0.3 mm and 1.0 mm including both the ends ($0.3 \leqq Wp \leqq 1.0$).

Further, in consideration of the above formula and To/Ti between 0.2 and 2.6 including both the ends ($0.2 \leqq To/Ti \leqq 2.6$), a minor-axis dimension Ht of the tube 2 is preferably set to between 0.8 mm and 2.0 mm including both the ends ($0.8 \leqq Ht \leqq 2.0$).

In this embodiment, an aluminum alloy is used whose tensile strength is between 50 and 220 N/mm$^2$ including both the ends ($50 \leqq S \leqq 220$); however, for an evaporator used in a vehicular air-conditioner using a refrigerant of $CO_2$, an alumina alloy preferably has a tensile strength between 110 and 200 N/mm2 including both the ends. The reason of not more than 200 N/mm$^2$ results from decrease in productivity. As the tensile strength increases, hardness typically increases to thereby increase abrasiveness of the mold, resulting in the decrease in productivity.

Figure 2B:
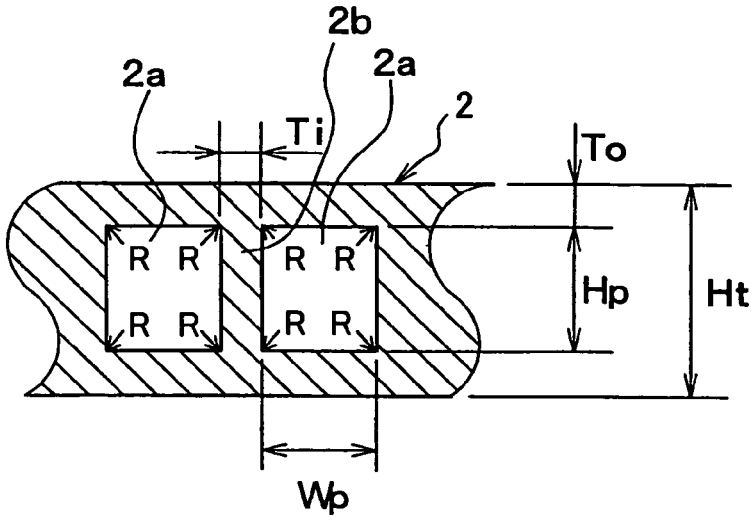
FIG. 2B is an enlarged view of a part IIB in FIG. 2A.

Further, as shown in FIG. 2B, each of the corners of the cross-sectional areas of the refrigerant channel 2*a* has a curvature radius R preferably less than 10% of whichever smaller one of Hp and Wp based on a relationship between the nucleate boiling and conductivity capability. The curvature radius not less than 10% restricts the nucleate boiling from the corners.

(Second Embodiment)

Figure 8A:
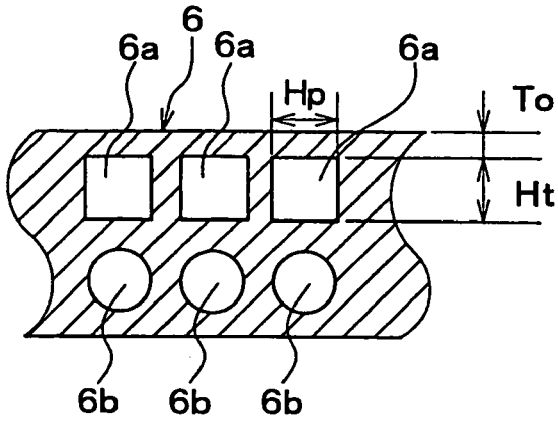
FIGS. 8A, 8B are cross-sectional views of a heat exchanger according to a second embodiment of the present invention.
Figure 8B:
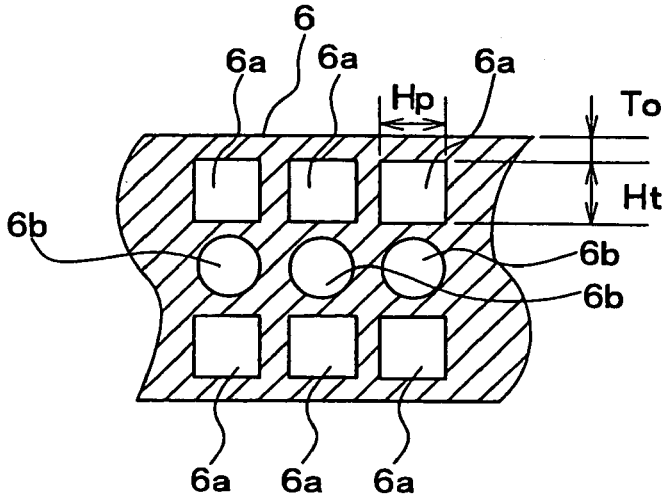

In the first embodiment, the present invention is directed to an evaporator, while, in a second embodiment, to an inner heat exchanger 6 shown in FIGS. 8A, 8B, as a tube of the invention. Here, the inner heat exchanger 6 is to heat exchange between a high-pressure refrigerant (e.g., refrigerant sent out from a radiator) and a low-pressure refrigerant (refrigerant sucked into a compressor). In FIGS. 8A, 8B, a low-pressure refrigerant flows through refrigerant channels 6*a* of quadrangular (angled) holes, while a high-pressure, through refrigerant channels 6*b* of circular holes. The inner heat exchanger 6 is formed by an extruding or drawing process together with the refrigerant channels 6*a*, 6*b*.

(Other)

Figure 9A:
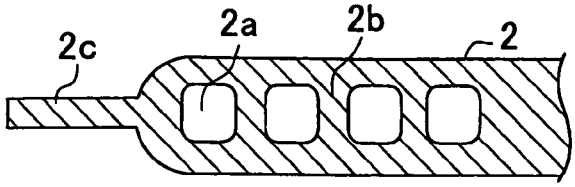
FIGS. 9A to 9I are cross-sectional views of tubes according to other embodiments of the present invention.
Figure 9B:
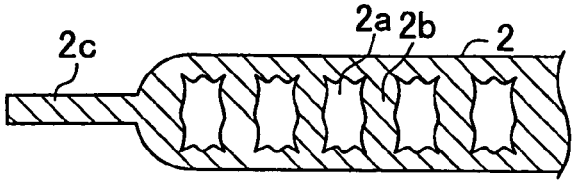

In the above embodiments, the refrigerant channel has a cross-sectional area of a square; however, without any limitation to the present invention, it can has a cross-sectional area of a different shape such as that of a rounded corner shown in FIG. 9A and that of a bumpy inner surface shown in FIG. 9B. Here, when the corner has a round shape, a curvature radius of the corner is preferably designed in such extent that conductivity capability is not restricted (e.g., less than 10% of dimension Wp or dimension of Hp).

In the above embodiments, all of the multiple refrigerant channels have the same shapes of the cross-sectional areas; however, without any limitation to the present invention, they can include, as shown in FIGS. 9D to 9H, a refrigerant channel 2*a* of a different shape such as a circular or triangular shape other than the square shape.

Further, as shown in FIGS. 9A, 9B, 9D, 9F, 9H, 91, the tubes can have protruding portions 2*c* at the major-axis end of it so that water condensed on the surfaces of the tubes 2 can preferably drain away.

Figure 9C:
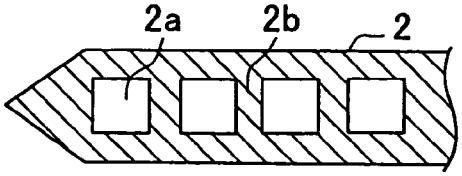
Figure 9D:
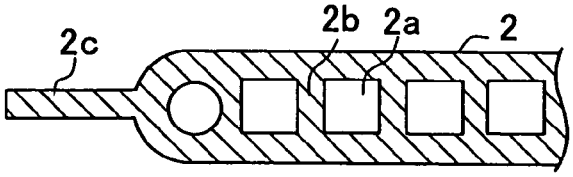
Figure 9E:
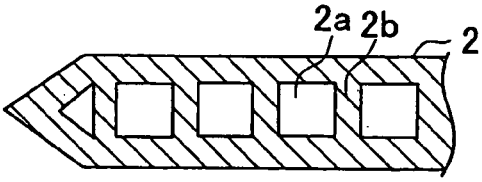
Figure 9F:
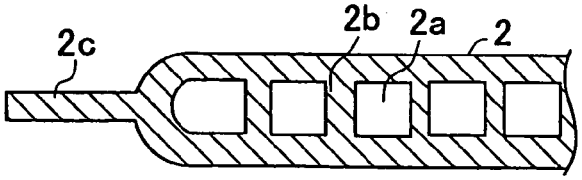
Figure 9G:
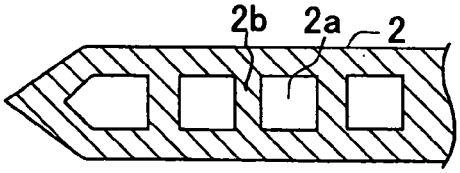
Figure 9H:
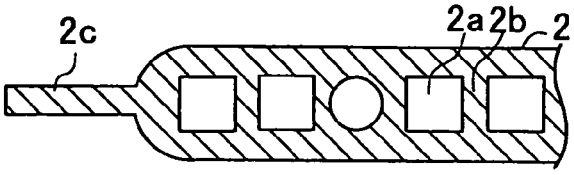
Figure 9I:
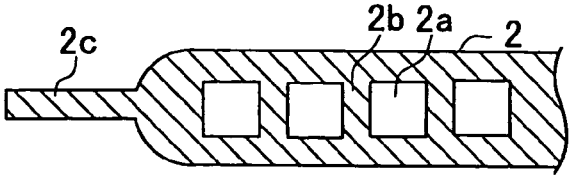

Further, as shown in FIGS. 9C, 9E, 9G, the tubes can have triangular shapes at the major-axis end of it so that water condensed on the surfaces of the tubes 2 can preferably drain away.

Further, as shown in FIGS. 9F, 9G, the tubes can include, near its major-axis end, refrigerant channels that have shapes along the peripheral shapes of the tube 2 so that the tubes 2 can be thinner.

Figure 10:
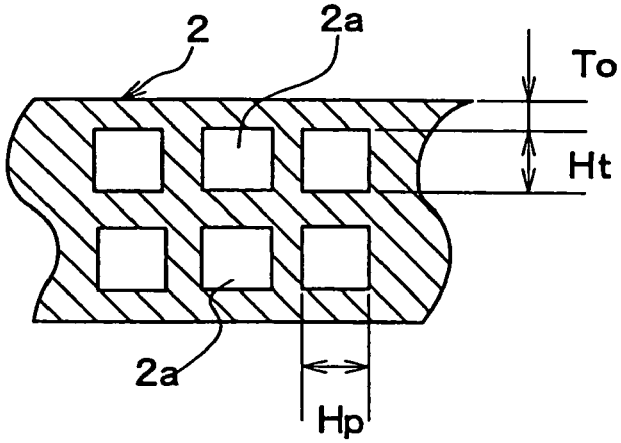
FIG. 10 is a cross-sectional view of a tube according to another embodiment of the present invention.

Further, as shown in FIG. 10, the tube can include, in its major-axis direction, multiple rows of refrigerant channels (two rows in FIG. 10).

In the above embodiment, it is described as $Ti=447\times Wp/10^A-533/10^B$, where $A=(1.54\times\log_{10}S)$, and $B=(1.98\times\log_{10}S)$; however, without any limitation, Ti can be included in a range as $(447\times Wp/10^A-533/10^B) \leqq Ti \leqq 2.3\times(447\times Wp/10^A-533/10^B)$, where $A=(1.54\times\log_{10}S)$, and $B=(1.98\times\log_{10}S)$.

In this embodiment, an aluminum alloy is used whose tensile strength is between 50 and 220 $N/mm^2$ including both the ends; however, this invention is not limited to this aluminum alloy.

In this embodiment, this invention is directed to an evaporator; however, without any limitation, it can be directed to a heat exchanger disposed at a low-pressure portion, which is used, for instance, for a supercritical cycle.

It will be obvious to those skilled in the art that various changes may be made in the above-described embodiments of the present invention. However, the scope of the present invention should be determined by the following claims.

What is claimed is:

1. A heat exchanger which is used in a vapor-compression type refrigerator where a pressure of a refrigerant at a high-pressure portion reaches and exceeds a critical pressure, the heat exchanger which a low-pressure refrigerant flows through, the heat exchanger comprising:

a flat tube;

refrigerant channels which are included in the tube and the low-pressure refrigerant flows through; and inner pillars that are disposed between the refrigerant channels, wherein a tensile strength of material of the tube is defined as S [$N/mm^2$]; of one of the refrigerant channels, a dimension approximately parallel with a major-axis direction of the tube is defined as Wp [mm]; and, of one of the pillars, a thickness approximately parallel with the major-axis direction of the tube is defined as Ti [mm], and wherein $[447\times Wp/\{10\hat{}(1.54\times\log_{10}S)\}-533/\{10\hat{}(1.98\times\log_{10}S)\}]\leqq Ti\leqq[447\times Wp/\{10\hat{}(1.54\times\log_{10}S)\}-533/\{10\hat{}(1.98\times\log_{10}S)\}]\times 2.3$.

2. The heat exchanger of claim 1, wherein $[447\times Wp/\{10\hat{}(1.54\times\log_{10}S)\}-533/\{10\hat{}(1.98\times\log_{10}S)\}]\leqq Ti\leqq[447\times Wp/\{10\hat{}(1.54\times\log_{10}S)\}-533/\{10\hat{}(1.98\times\log_{10}S)\}]\times 1.8$.

3. The heat exchanger of claim 1, wherein a thickness approximately parallel with a minor-axis direction of the tube is defined as To [mm], and wherein $0.2\leqq To/Ti\leqq 2.6$.

4. The heat exchanger of claim 3, wherein $0.5\leqq To/Ti\leqq 2.0$.

5. The heat exchanger of claim 4, wherein $1.5-(0.325/Ti)\leqq To/Ti\leqq 1.5+(0.325/Ti)$.

6. The heat exchanger of claim 1, wherein 50 N/mm2≦S≦220 N/mm2.

7. The heat exchanger of claim 6, wherein 110 N/mm2≦S≦200N/mm2.

8. The heat exchanger of claim 1, wherein 0.3 mm≦Wp≦1.0 mm, wherein, of one of the refrigerant channels, a dimension approximately parallel with a minor-axis direction of the tube is defined as Hp [mm], and wherein 0.3 mm≦Hp≦1.0 mm.

9. The heat exchanger of claim 8, wherein a curvature radius of a corner of one of the refrigerant channels is less than 10% of whichever smaller one of Wp and Hp.

10. The heat exchanger of claim 1, wherein, of the tube, a dimension in a minor-axis direction is defined as Ht [mm], and wherein $0.8\leqq Ht\leqq 2.0$.

11. The heat exchanger of claim 1, wherein the refrigerant includes carbon dioxide.

* * * * *